US005926959A

United States Patent [19]

Collins

[11] Patent Number: 5,926,959

[45] Date of Patent: Jul. 27, 1999

[54] LOCKING KNIFE AND SHEATH

[76] Inventor: Walter W. Collins, P.O. Box 100, North, S.C. 29112

[21] Appl. No.: 08/971,832

[22] Filed: Nov. 17, 1997

[51] Int. Cl.[6] ..... B26B 29/02

[52] U.S. Cl. ..... 30/162; 30/151; 224/232

[58] Field of Search ..... 30/151, 162; 224/232, 224/197

[56] References Cited

U.S. PATENT DOCUMENTS

| | | | |
|---|---|---|---|
| 1,237,075 | 8/1917 | Martelli . | |
| 2,391,574 | 12/1945 | Housinger | 224/2 |
| 2,793,434 | 5/1957 | Wigington | 30/151 |
| 4,827,614 | 5/1989 | Mitchell | 30/151 |
| 5,123,167 | 6/1992 | Kelley | 30/151 |
| 5,138,768 | 8/1992 | Collins | 30/151 |
| 5,255,436 | 10/1993 | Yoshida | 30/151 |
| 5,297,341 | 3/1994 | Collins | 30/162 |
| 5,315,761 | 5/1994 | Norton et al. | 30/162 |
| 5,379,520 | 1/1995 | Collins | 30/162 |
| 5,511,311 | 4/1996 | Collins | 30/162 |
| 5,647,130 | 7/1997 | Collins | 30/151 |

*Primary Examiner*—Hwei-Siu Payer

*Attorney, Agent, or Firm*—Leatherwood Walker Todd & Mann, P.C.

[57] ABSTRACT

A locking knife and sheath combination which provides for automatic locking of the knife when inserted to the sheath and which allows release of the knife from the sheath by a squeezing of the knife's handle. The handle is provided with a locking lever on each edge thereof which engages with receivers on the sheath. The locking levers are spring-biased outwardly such that insertion of the knife into the sheath causes automatic engagement of the locking levers with the receivers on the sheath. Simultaneous inward squeezing of both of the locking levers, occasioned by the user's grasping of the knife's handle, causes the knife to disengage from the sheath to allow removal of the knife therefrom.

14 Claims, 6 Drawing Sheets

3
K
10
52
6
54
6
5
R
5
5
3

12
20
18
14
12
24
K
28
14
48
20
50
68
70
B
60

LOCKING KNIFE AND SHEATH

BACKGROUND OF THE INVENTION

This invention relates generally to a knife which automatically locks within a sheath upon insertion therein and which is releasable from the sheath through the squeezing of the handle of the knife.

When carrying a sheath knife, it is often desirable to have the knife securely locked in the sheath to prevent it from falling out inadvertently. This can be especially critical in adverse environmental conditions, such as those which may be faced by rescue workers, military and police personnel, back packers, SCUBA divers, etc. Providing means to lock the knife within the sheath have been developed, but most such designs require some special attention from a user when they are removed from the sheath, such as the depression of a certain tab, removal of a hasp or loop, etc., which can divert the user's attention from the task at hand. This can be particularly distracting in the case of SCUBA divers, where little or no light is available, and the diver's frame of reference may be skewed.

It would thus be desirable to provide a sheath-type knife which will cause the knife to automatically lock to the sheath once inserted therein, and which will also allow the knife to be quickly extracted from the sheath by the user through use of a natural, and comfortable motion which will minimize distraction to the user.

Other locking knife and sheath designs are known. For example, U.S. Pat. No. 5,123,167, issued to Kelley, discloses a knife with sheath engageable lock, wherein a flexible segment having a latch thereon engages with a recess provided in the sheath. U.S. Pat. No. 4,827,614, issued to Mitchell, discloses a locking tool handle holder arrangement having elongated springs provided in the handle. One end of each spring is fastened to the handle, while the other end includes an upturned portion recited as locking pin means. Activators are provided on the sides of the handle, and when squeezed inwardly towards one another, springs are forced downwardly by curved surfaces of activators. This causes a corresponding retraction of locking pin means, and consequently, unlocking of the handle from sheath. In the locking configuration, locking pin means extend through respective openings in the sheath. U.S. Pat. No. 2,793,434, issued to Wigington, discloses a knife having a pivoting catch for engaging a sheath. U.S. Pat. No. 2,391,574, issued to Housinger, discloses a knife having a spring arm with a pin thereon for engaging with a notch in a sheath.

SUMMARY OF THE INVENTION

It is, therefore, the principal object of this invention to provide a locking knife and sheath combination which allows for automatic locking of a knife to a sheath when the knife is inserted therein, and which allows for quick and easy unlocking of the knife by simply grasping and squeezing the handle of the knife.

Another object of the present invention is to provide a locking knife and sheath which allows for the knife to automatically be locked within the sheath regardless of the orientation of the front or back of the knife's handle with respect to the front or back of the sheath.

Still another object of the present invention is to provide a locking knife and sheath which can be attached to the user, or some other object, in a variety of different orientations.

Yet another object of the present invention is to provide a locking knife and sheath combination having a locking mechanism suitable for prolonged underwater use and which is resistent to intrusion of sand and other debris.

Generally, the present invention includes a knife and sheath combination, comprising a knife having elongated blade and a handle connected to the elongating blade. The handle includes a front portion and a back portion opposite the front portion and also a first side portion and a second side portion opposite the first side portion. The first side portion is of less width than the front portion.

At least one locking lever is pivotally or swingingly attached to at least one side of the handle, and the locking lever has locking portion moveable between a locking position and a release position.

The present invention also includes a knife receptacle defining a blade compartment for receiving the blade of the knife and a second locking portion for cooperating with the locking portion of the locking lever, such that insertion of the blade into the blade compartment automatically causes the second locking portion to move to the locking position and to cooperate with the locking portion to lock the knife in the knife receptacle.

The present invention provides a locking knife and sheath wherein once the knife is locked within a sheath, the user needs only to grasp and squeeze the handle in order to remove the knife from the sheath. The natural grasping motion of a human hand will put finger and/or thumb pressure on both sides of the handle of the handle of the knife, and, in the preferred embodiment, this motion will automatically depress two locking levers which are located on the sides of the handle. These locking levers are positioned in such a manner as to allow them to move inwardly into the sides of the handle against spring pressure, which normally holds them in an outward position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
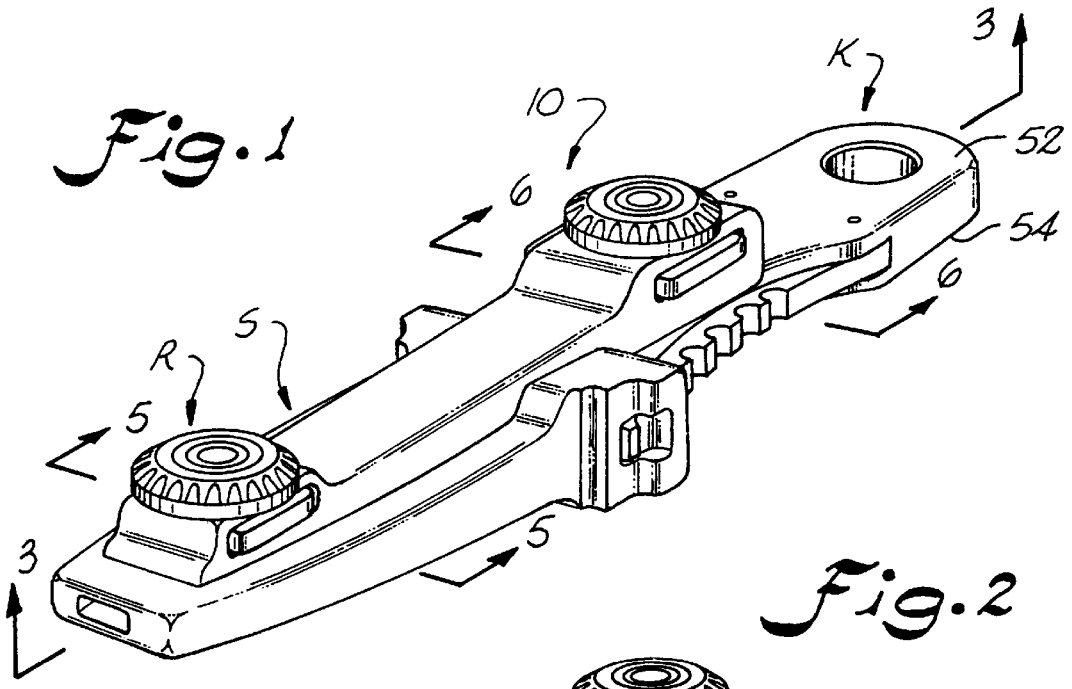
FIG. 1 is a perspective view of a locking knife and sheath constructed in accordance with the present invention.

The accompanying drawings and the description which follows set forth this invention in its preferred embodiment.

However, it is contemplated that persons generally familiar with knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the locking knife and sheath of the present invention is indicated generally in the figures by reference character 10.

Figure 2:
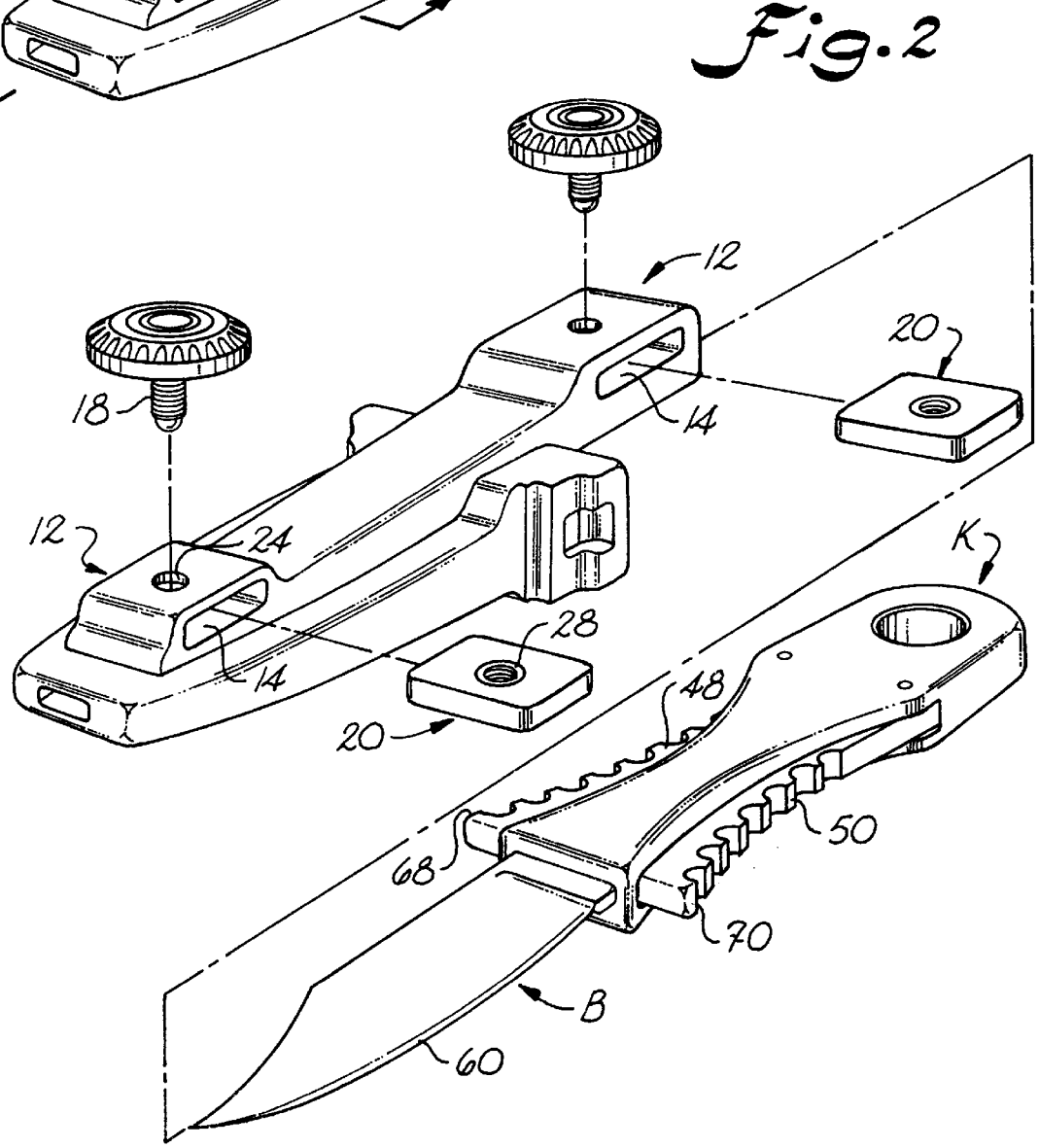
FIG. 2 is an exploded view of a locking knife and sheath constructed in accordance with the present invention.

In FIG. 1, locking knife and sheath combination 10 includes a knife, generally K and a sheath, generally S. Knife K is locked within sheath S in the FIG. 1 view. FIG. 2 illustrates knife K removed from sheath S and further illustrates strap receptacles, generally 12, which are provided on sheath S. The strap receptacles 12 each have a strap opening 14 for receiving a strap, belt, band, etc., for a fixing sheath S to a user, or some other object. Alternately, sheath S may be attached to a belt, strap, harness, webbing, or a layer of material through the use of strap retainers, generally R, having threaded fasteners, generally 18, and strap receptacle inserts, generally 20, as illustrated in FIG. 5.

Figure 5:
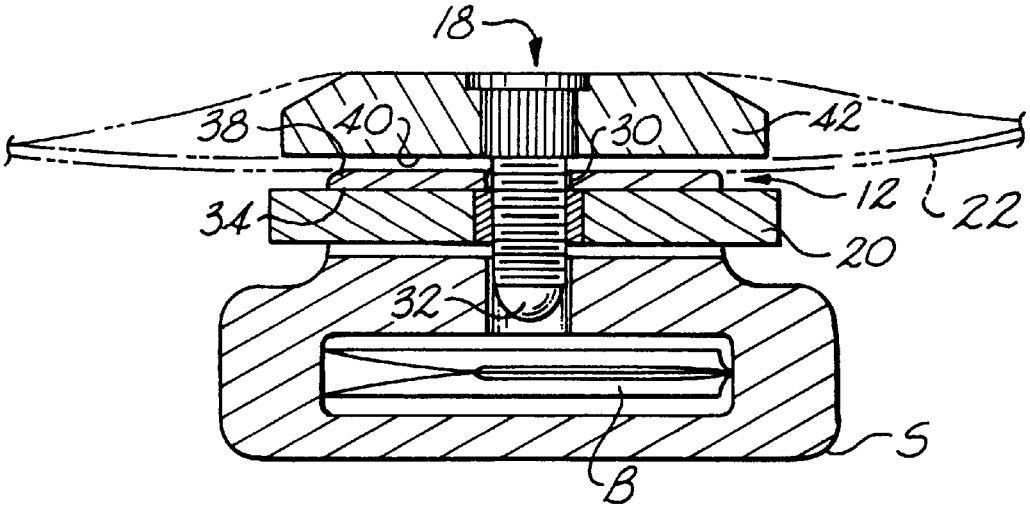
FIG. 5 is a sectional view taken along lines 5—5 of FIG. 1.

In FIG. 5, sheath S is shown attached to a layer of material, such as a harness or strap 22. Threaded fastener 18 passes through a bore 24 in strap receptacle 12 and engages with a threaded boss 28 provided in a strap insert 20. Preferably, the item to which sheath S is being attached includes holes for cooperating with threaded fastener 18 and bore 24, and strap 22 includes such a hole 30. Alternately, the tip 32 of the threaded fastener 18 could be used to punch a hole in the strap 22, or other material, in order to form a passage through which the threaded fastener 18 could extend.

Figure 6:
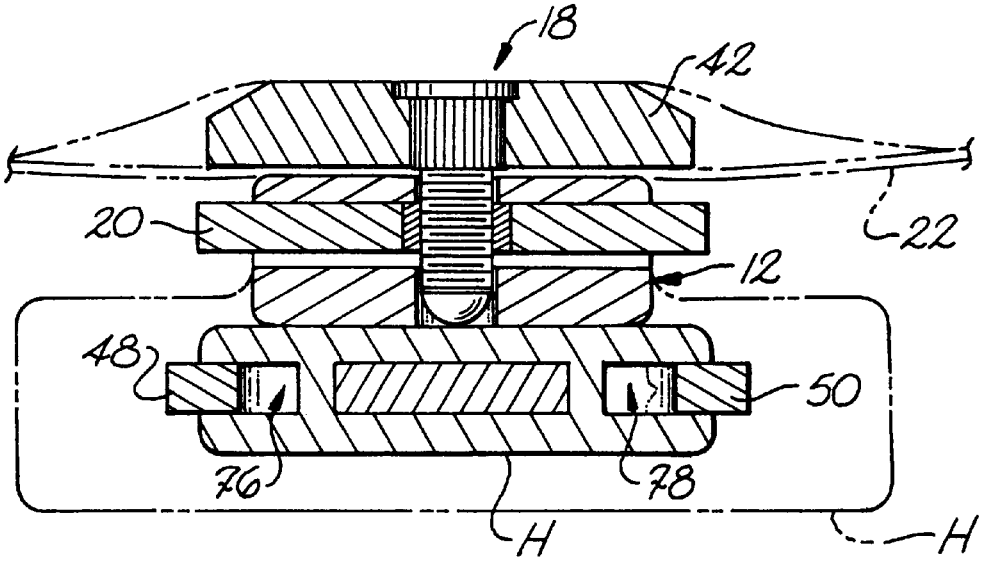
FIG. 6 is a sectional view taken along lines 6—6 of FIG. 1.

As threaded fastener 18 is turned, strap insert 20 is captured since it cannot rotate within strap receptacle 12. However, it will move upwardly toward threaded fastener 18, as shown in FIGS. 5 and 6, as threaded fastener 18 is turned in a tightening (typically clockwise) direction. Further turning of fastener 18 will cause strap insert 20 to abut the upper surface 34 within strap opening 14 and will also cause harness strap 22 to be tightly bound between the upper face 38 of strap receptacle 12 and the bottom surface 40 of the enlarged head 42 of threaded fastener 18. Preferably, two strap retainers R are provided to secure sheath S to an object. By providing two such strap retainers, the sheath is constrained from rotation. However, it is to be understood that more or less strap receptacles could also be used, if desired.

FIG. 2 also illustrates knife K having two swinging locking levers 48, 50 provided in handle H of knife K. Handle H includes a front portion 52, and a back portion 54 opposite front portion 52. Handle H also includes, as illustrated in FIG. 2, a left side portion 56 and a right side portion 58 opposite left side portion 56. Locking levers 48, 50 are carried for swinging movement with respect to left side 56, and right side 58, respectively.

Extending outwardly from handle H is a blade, generally B, having a sharpened cutting edge 60. Opening 61 is provided for use as lanyard hole, but it could also be used for hanging knife K from a hook or the like or for providing access to the finger of a user. Blade B is preferably constructed of cutlery steel, and handle H is preferably constructed of glass filled nylon, plastic, wood, metal, or some other suitable material. Levers 48, 50 are preferably constructed of glass-filled nylon, plastic, or some other elastic material for allowing the levers to act as leaf springs.

Figure 3:
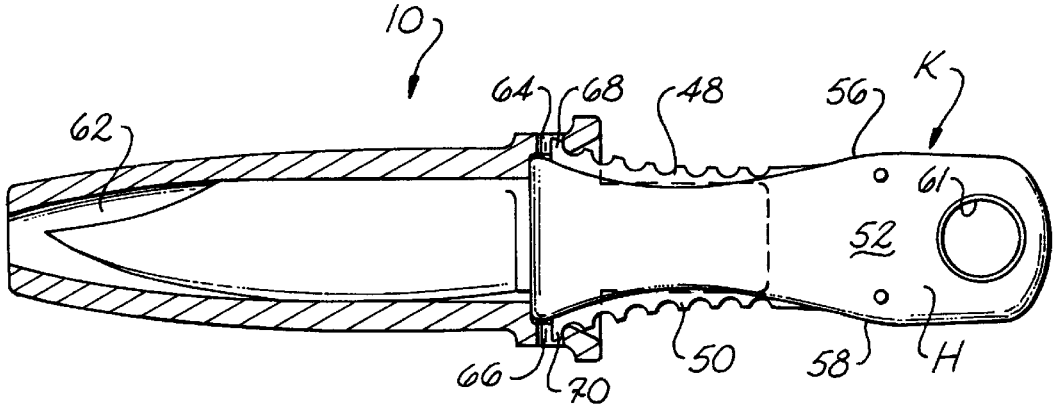
FIG. 3 is a sectional view taken along lines 3—3 of FIG. 1.

FIG. 3 illustrates knife K locked within sheath S using locking means, generally M, described below. Sheath S includes a knife compartment or receptacle, generally 62, for receiving blade B of knife K. Sheath S also defines locking notches, or passages, 64 and 66. Locking notches 64, 66 receive, respectively, locking tabs 68, 70. Locking tabs 68, 70 are provided, respectively, on locking levers 48, 50. When locking levers 48, 50 are in the locking position illustrated in FIG. 3, the engagement between the locking tabs of locking levers 48, 50 and the locking passages of sheath S securely retain the knife within the sheath. Locking means M may also includes the reversal of the locking notches and locking tabs, such that locking notches 71*a* and 73*a* are provided in the locking levers, and the projections 71, 73 on the sheath engage with those notches 71*a*, 73*a*, to lock the knife to the sheath.

Figure 4:
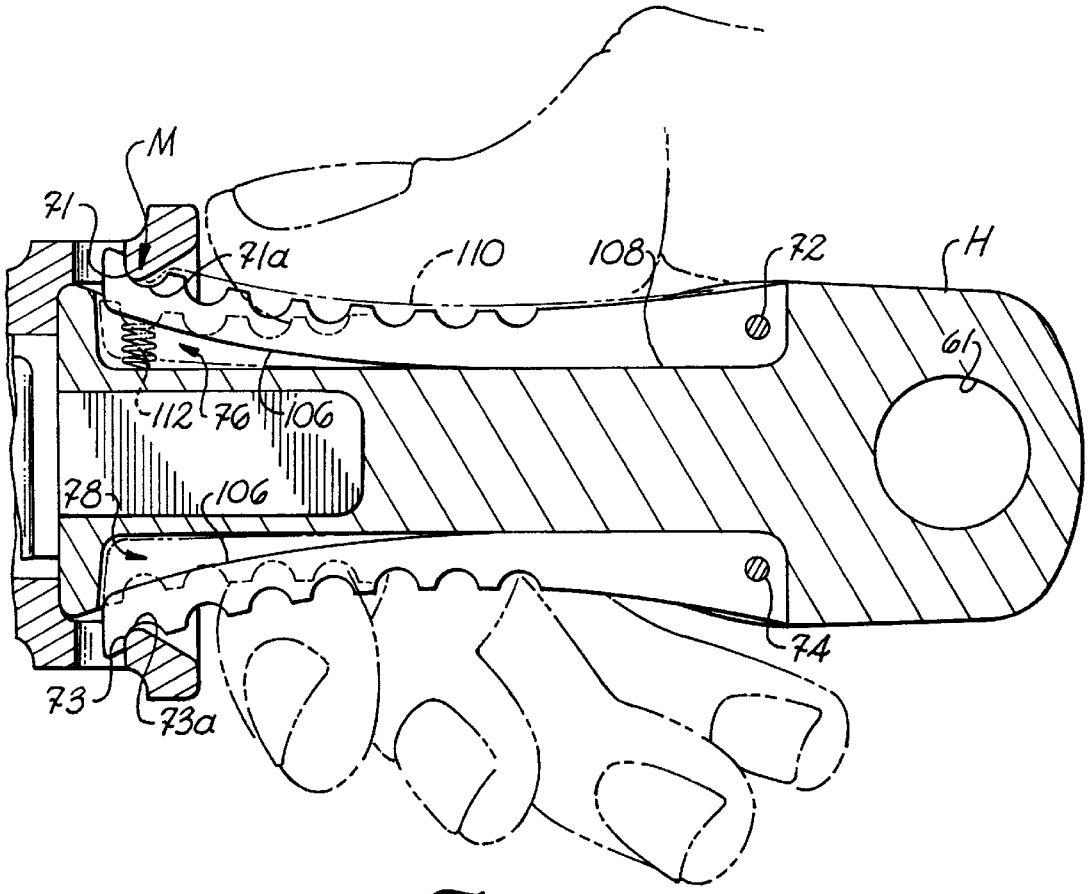
FIG. 4 is a partial sectional view of a knife handle constructed in accordance with the present invention.

FIG. 4 illustrates a sectional view of handle H of knife K. From this view, it can be seen that locking levers 48, 50 are pivotally attached to handle H by pivot pins 72, 74, respectively. Locking lever channels 76, 78 are provided in the left and rights sides 56, 54 of handle H, respectively, to receive the locking levers as they move between their locking position, as shown in solid lines in FIG. 4, and their release position, as shown in phantom in FIG. 4.

When the locking levers are in the phantom position of FIG. 4, it can be seen that locking tabs 68, 70 no longer engage locking notches 64, 66 of sheath S, thereby allowing knife K to be withdrawn from sheath S.

FIGS. 5 and 6, discussed above, illustrate the use of strap receptacles 12 for attaching sheath S to a layer of material of a garment or other article, belt, back pack, or strap such as harness strap 22.

Figure 5A:
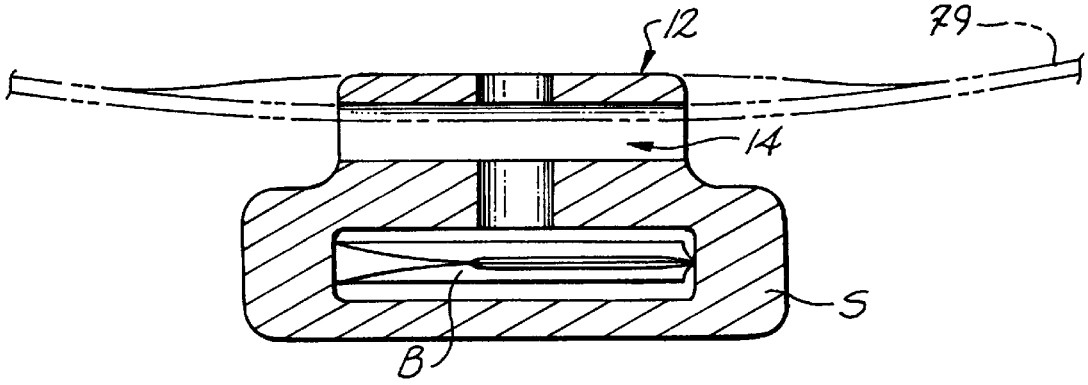
FIG. 5A is a sectional view similar to FIG. 5 except the sheath retention members have been removed.
Figure 6A:
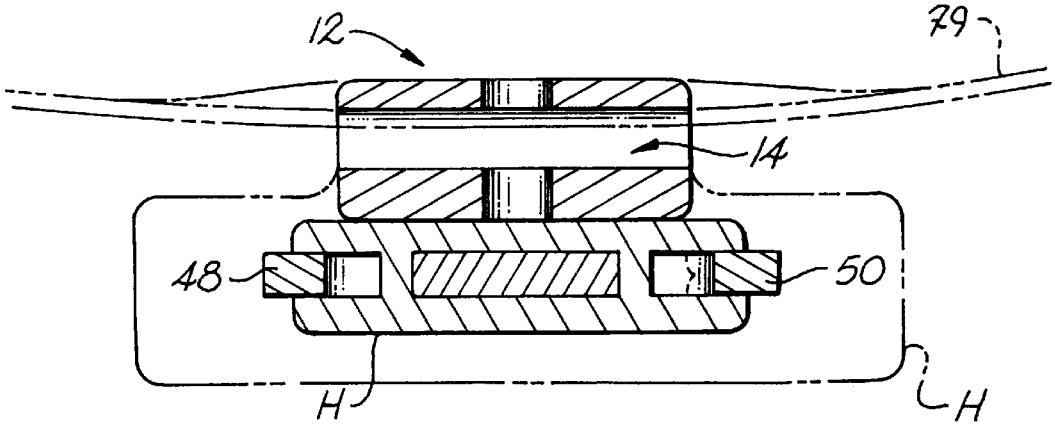
FIG. 6A is a sectional view similar to FIG. 6, except that the sheath retention members have been removed.
Figure 9:
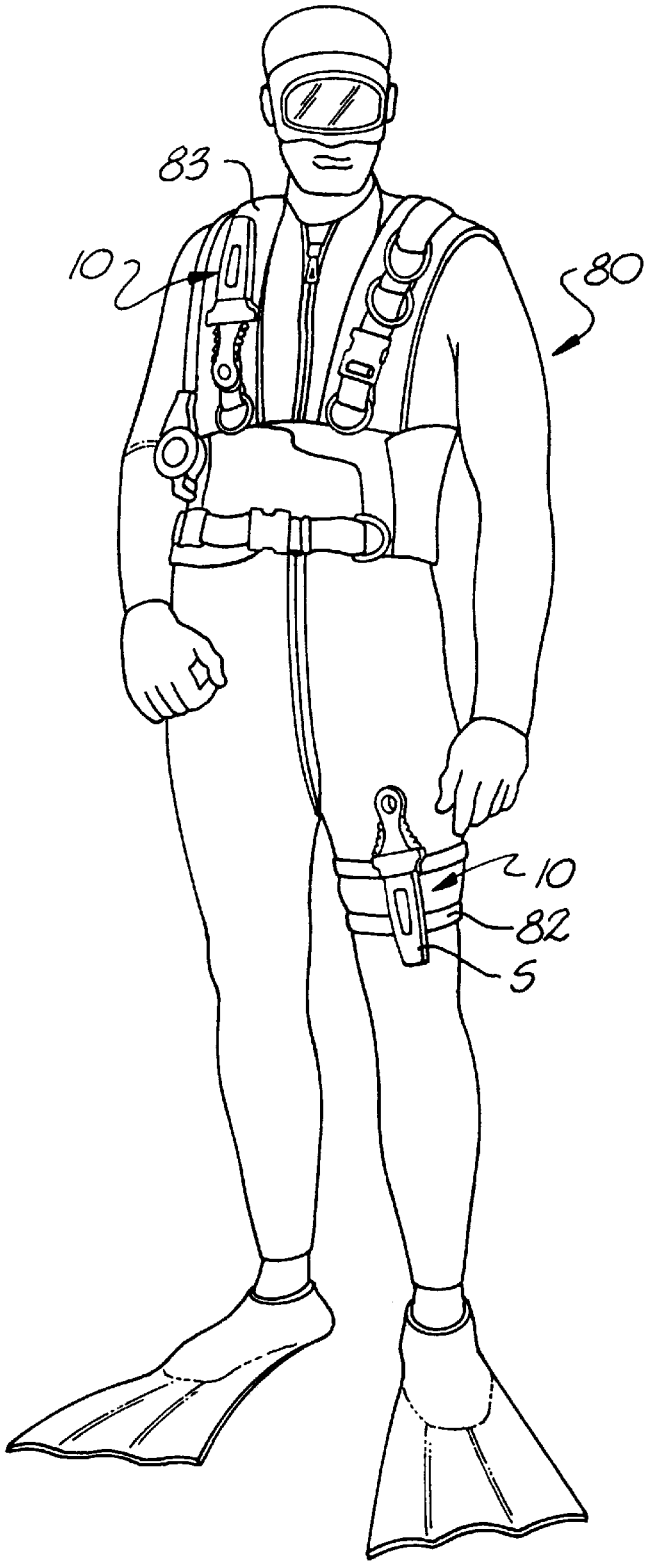
FIG. 9 is a prospective view of a user wearing two knife and sheath combinations of the present invention.

FIGS. 5A and 6A illustrate strap receptacles 12 without sheath retainers R, having a strap 79 passing through passage 14. When strap receptacles 12 are in this configuration, a belt or strap, cord, or the like, is inserted in the opening 14 of one or more receptacles 12 in order to retain sheath S on the user, or on some other object. FIG. 9 illustrates a user 80 having sheath S strapped to his leg, wherein straps 82 pass through strap openings 14. A further unit of the present invention 10 is attached to a harness strap 83 worn by the user.

Figure 7:
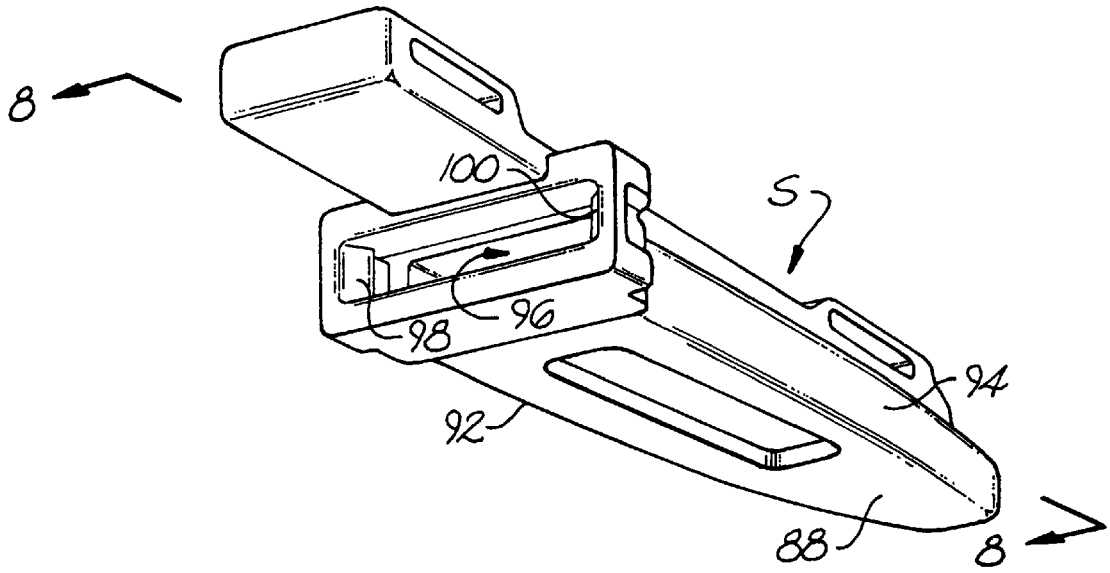
FIG. 7 is a perspective view of a sheath constructed in accordance with the present invention.
Figure 8:
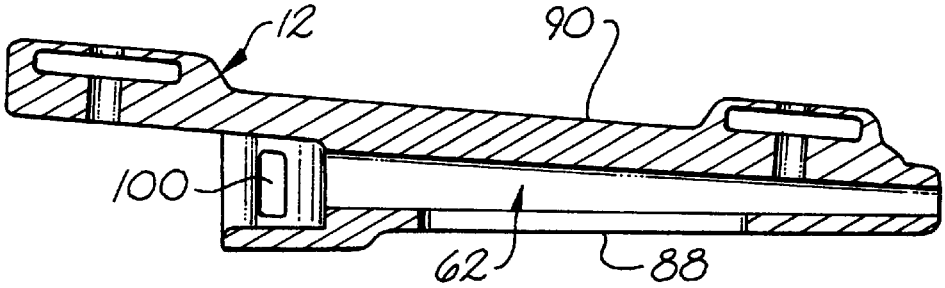
FIG. 8 is a sectional view taken along lines 8—8 of FIG. 7.

FIG. 7 illustrates sheath S in further detail. Sheath S includes a front portion 88 and a rear portion 90, and as illustrated in FIG. 7, a left side portion 92 and a right side portion 94. The entrance or throat 96 of blade compartment 62 includes ramps 98, 100 positioned opposite one another on the left and right sides, respectively, of throat 96. These ramps, which taper inwardly toward blade receptacle 62, serve to engage and depress locking tabs 68, 70 of locking levers 48, 50 as knife K is inserted into sheath S. Upon initial insertion of the knife into the sheath, locking levers 48, 50 automatically move toward the release position. However, as the knife is further inserted into this sheath, locking tabs 68, 70 clear the projections 71, 73 of ramps 98, 100, and because of the spring resiliency of levers 48, 50, the locking tabs 68, 70 automatically spring outwardly to engage the locking notches 64, 66 of sheath S.

FIG. 4 illustrates in phantom the flattening of locking levers 48, 50 as the back side, generally 106, of each locking lever approaches the base, generally 108, of each locking channel 76, 78. This flattening of the locking levers causes the levers to act in essence as leaf springs, since the locking levers are preferably constructed of a material such as plastic having elastomeric qualities, or of metal or wood having similar spring-type characteristics. The back side 106 of the levers automatically moves away from the base 108 of the locking lever channels 76, 78 once locking tabs 68, 70 clear corners 102, 104 of ramps 98, 100.

If desired, a flexible rubber or plastic covering, generally 110, (as shown in phantom at FIG. 4) can be provided for sealing both locking levers 48, 50 and locking lever channels 76, 78, respectively from the influx of dirt, and other foreign matter. Further, a coil spring 112, such as illustrated in phantom in FIG. 4, could also be used in connection with one or more of the locking levers to provide substitute or additional spring biasing of the locking levers outwardly to their locking position.

In use, the knife K is automatically locked within sheath S by simply inserting knife K into sheath S far enough such that the locking tabs 68, 70 are depresses by ramps 98, 100 and then engage with the locking notches 64, 66 of sheath S. Removal of knife K is easily accomplished by simply squeezing the sides of handle H in such a manner that locking levers 48, 50 move inwardly within channels 76, 78 to the point that the locking tabs of the locking levers clear the locking notches of sheath S. Knife K can then easily be withdrawn from sheath S.

Although knife K is illustrated as having two locking levers, one in each side of handle H, it is to be understood that knife K could also be constructed having one locking lever, or, if desired, more than two locking levers.

The present invention thus allows for a knife to be easily inserted and automatically locked within a sheath by simply pushing the knife into the sheath. Removal of the knife from the sheath is allowed by simply gripping and squeezing the knife's handle and withdrawing the knife from the sheath. The mechanism can be operated in total darkness, as it does not require visual contact by the user.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A knife and knife receptacle combination, comprising:

a knife having an elongated blade and a handle connected to said elongated blade, said handle having a front portion and a back portion opposite said front portion and a first side portion and a second side portion opposite said first side portion, said first side portion being of less width than said front portion;

at least one locking lever swingingly attached to said first side portion of said handle, said locking lever having a locking tab, and said locking lever being moveable between a locking position and a release position; and said first side portion of said handle defining an elongated locking lever channel for receiving said locking lever as said locking lever moves between said locking position and said release position;

an elongated body member defining a blade compartment for receiving said blade of the knife and a locking notch for cooperating with said locking tab, said elongated body member being configured such that insertion of said blade into said blade compartment automatically causes said locking tab to move inwardly towards said first side portion of said handle and then, upon further insertion of said blade into said compartment, causes said locking tab to move towards said locking position to cooperate with said locking notch to lock said blade in said blade compartment, said knife being removable from said blade compartment by simultaneously moving said locking lever to said release position and withdrawing said blade from said blade compartment.

2. The combination as defined claim 1, wherein said locking lever is spring-biased toward said locking position.

3. The combination as defined in claim 1, wherein said at least one locking lever includes two locking levers, with one of said locking levers being connected to said first side portion of said handle and the other of said locking levers being connected to said second side portion of said handle.

4. The combination as defined in claim 1, wherein said at least one locking lever is pivotally attached to said knife handle.

5. The combination as defined in claim 1, wherein said locking lever is cantileverly attached to said handle.

6. The combination as defined in claim 1, wherein said locking lever is a leaf spring.

7. The combination as defined in claim 1, further comprising a flexible cover covering said locking lever and substantially sealing said locking lever channel from foreign debris.

8. The combination as defined in claim 1, wherein said elongated body member includes at least one strap receptacle.

9. The combination as defined in claim 8, further comprising a strap insert for receipt in said strap receptacle and a fastener for substantially fixing said strap insert within said strap receptacle.

10. The combination as defined in claim 9, wherein said fastener is a threaded fastener and wherein said strap insert includes a threaded receiver for receiving said threaded fastener.

11. A knife and knife receptacle combination, comprising:

a knife having an elongated blade and a handle connected to said elongated blade, said handle having a front portion and a back portion opposite said front portion and a first side portion and a second side portion opposite said first side portion, said first side portion being of less width than said front portion;

at least one locking lever swingingly attached to said first side portion of said handle, said locking lever having a first locking portion moveable between a locking position and a release position; and said first side portion of said handle defining an elongated locking lever channel for receiving said locking lever as said locking lever moves between said locking position and said release position; and an elongated body member defining a blade compartment for receiving said blade of the knife and a second locking portion for cooperating with said first locking portion, said elongated body member being configured such that insertion of said blade into said blade compartment automatically causes said first locking portion to move inwardly towards said first side portion of said handle and then, upon further insertion of said blade into said compartment, causes said first locking portion to move towards said locking position to cooperate with said second locking portion to lock said blade in said blade compartment, and wherein said first locking portion is a recess and said second locking portion is an outwardly projecting tab for being received in said recess.

12. A knife and knife receptacle combination, comprising:

a knife having an elongated blade and a handle connected to said elongated blade, said handle having a front portion and a back portion opposite said front portion and a first side portion and a second side portion opposite said first side portion;

an elongated body member defining a blade compartment configured for receiving said blade;

locking means connected to said handle for selectively locking the knife in said body member;

a lever pivotally connected to each of said first and second side portions of said handle for releasing said locking means upon the simultaneous squeezing of said first and second side portions of said handle, to thereby allow removal of said knife from said body member; and a spring between each of said levers and each of said first and second side portions for biasing each of said levers outwardly from said handle.

13. A knife and sheath combination, comprising:

a knife having an elongated blade and a handle connected to said elongated blade, said handle having a front portion and a back portion opposite said front portion and a first side portion and a second side portion opposite said first side portion;

a first locking lever swingingly attached to said first side portion of said handle and a second locking lever swingingly attached to said second side portion of said handle;

said first and second locking levers each having a first locking portion moveable between a locking position and a release position, and each of said first and second locking levers being spring-biased toward said locking position; and a sheath including an elongated body member defining a blade compartment for receiving said blade of the knife and defining second locking portions for cooperating with said first locking portion of each of said first and second locking levers, such that insertion of said blade into said blade compartment automatically causes said first locking portion of each of said first and second locking levers to move to said locking position and to lockingly cooperate with said second locking portions to lock said knife to the sheath;

said sheath including at least one strap receptacle, a strap insert for receipt in said strap receptacle, and a fastener for substantially fixing said strap insert within said strap receptacle.

14. The combination as defined in claim 13, wherein said first locking portion is an outwardly projecting tab and said second locking portion is a recess for receiving said outwardly projecting tab.

* * * * *